US011220833B2

(12) United States Patent
Chiu

(10) Patent No.: US 11,220,833 B2
(45) Date of Patent: Jan. 11, 2022

(54) PARKING GARAGE ELEVATOR SYSTEM

(71) Applicant: Shih-Tsai Chiu, Pingtung County (TW)

(72) Inventor: Shih-Tsai Chiu, Pingtung County (TW)

( * ) Notice: Subject to any disclaimer, the term of this patent is extended or adjusted under 35 U.S.C. 154(b) by 0 days.

(21) Appl. No.: 17/020,850

(22) Filed: Sep. 15, 2020

(65) Prior Publication Data

US 2020/0407997 A1 Dec. 31, 2020

(51) Int. Cl.
*E04H 6/18* (2006.01)
*E04H 6/42* (2006.01)

(52) U.S. Cl.
CPC ..... *E04H 6/188* (2013.01); *E04H 6/42* (2013.01)

(58) Field of Classification Search
CPC .... E04H 6/14; E04H 6/06; E04H 6/12; E04H 6/42; E04H 6/188; B66F 7/00; B66F 7/28; B66F 2700/12
See application file for complete search history.

(56) References Cited

U.S. PATENT DOCUMENTS 5,497,854 A * 3/1996 Fang ..... B66B 5/26 187/209
7,597,521 B2 * 10/2009 Wastel ..... E04H 6/188 414/240
2004/0238285 A1 * 12/2004 Stokes ..... B66F 7/02 187/208
2010/0272545 A1 * 10/2010 Stokes ..... E04H 6/06 414/233
2020/0232238 A1 * 7/2020 Kritzer ..... E04H 6/188

* cited by examiner

*Primary Examiner* — Kaitlin S Joerger

(57) ABSTRACT

A parking garage elevator system includes a frame including two front posts, two rear posts, two upper support members each interconnecting upper ends of the front and rear posts of the same side, two middle support members each interconnecting intermediate portions of the front and rear posts of the same side, and two cross braces each interconnecting front ends or rear ends of the upper support members; upper and lower automobile platforms; a power transmitting mechanism including first and second electric motors and two chains each for transferring power from the first electric motor to the upper automobile platform or from the second electric motor to the lower automobile platform; and a safety mechanism including four sets of two safety hooks and a plurality of restrain screws on the upper automobile platform or the lower automobile platform.

10 Claims, 11 Drawing Sheets

PARKING GARAGE ELEVATOR SYSTEM

BACKGROUND OF THE INVENTION

1. Field of the Invention

The invention relates to parking garages and more particularly to a parking garage elevator system having two automobile platforms driven by electric motors and chains.

2. Description of Related Art

A conventional parking garage elevator system having an automobile platform exclusive of the ground is disadvantageous because it has many complicated components including driving members, is bulky and is prone to malfunction.

Another conventional parking garage elevator system having two automobile platforms exclusive of the ground is advantageous because it has a simple structure, is less to malfunction, and is safer in operation. However, it still has the problems including interferences of components including automobile platforms and frame in operation and insufficient structural strength.

Thus, the need for improvement still exists.

SUMMARY OF THE INVENTION

It is therefore one object of the invention to provide a parking garage elevator system, comprising a frame, a platform assembly, a power transmitting mechanism, and a safety mechanism wherein the frame includes two front posts, two rear posts, two upper support members each interconnecting upper ends of the front and rear posts of the same side, two middle support members each interconnecting intermediate portions of the front and rear posts of the same side, and two cross braces each interconnecting front ends or rear ends of the upper support members; the platform assembly is horizontally disposed in the frame and includes an upper automobile platform under the upper support members, and a lower automobile platform under the middle support members, each of the upper and lower automobile platforms include a front suspension seat and a rear suspension seat; a guide roller; and two projections along two sides respectively and a parking zone between the projections; the power transmitting mechanism is configured to lift or lower the upper automobile platform and/or the lower automobile platform and includes a first electric motor on the upper support member, a second electric motor on the middle support member, and two chains each for transferring power from the first electric motor to the upper automobile platform or from the second electric motor to the lower automobile platform, the first electric motor and the second electric motor being spaced apart; and the safety mechanism is configured to prevent each of the upper and lower automobile platforms from falling in a lifting or lowering operation and includes four sets of two safety hooks, the upper two sets of the safety hooks being disposed under the upper support members and the lower two sets of the safety hooks being provided under the middle support members; and a plurality of restrain screws disposed on the upper automobile platform or the lower automobile platform.

The above and other objects, features and advantages of the invention will become apparent from the following detailed description taken with the accompanying drawings.

DETAILED DESCRIPTION OF THE INVENTION

Figure 1:
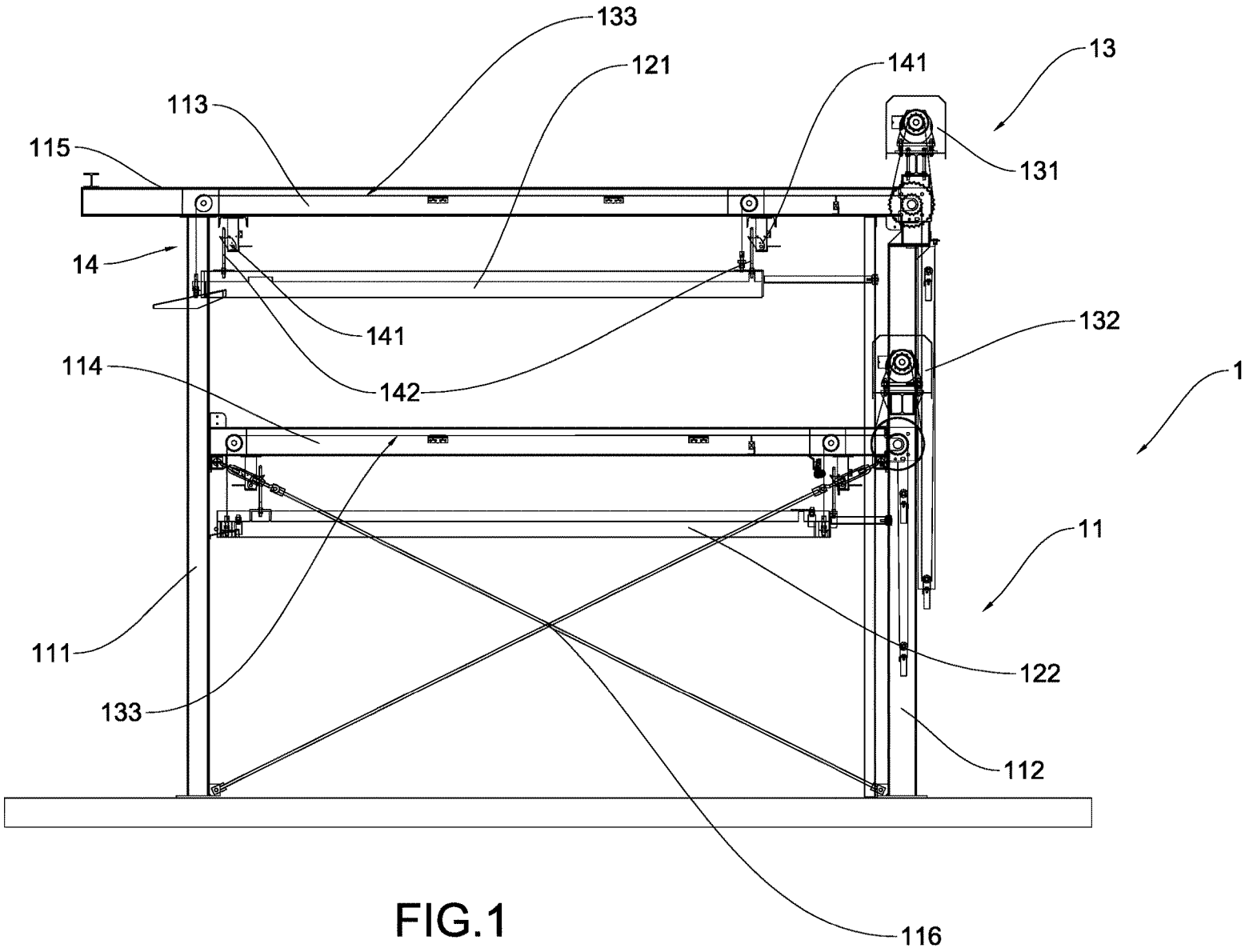
FIG. 1 is a side elevation of a parking garage elevator system according to the invention.
Figure 2:
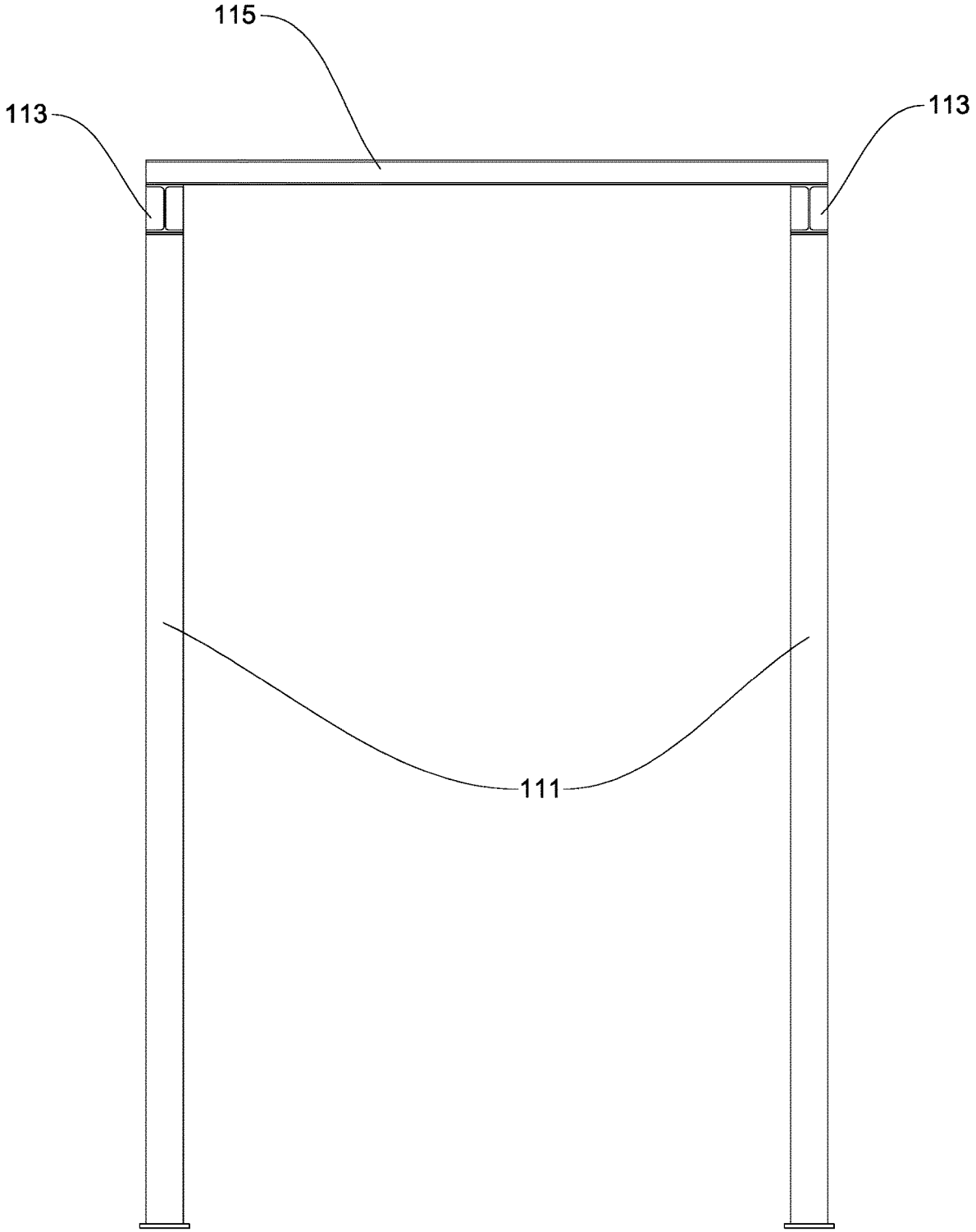
FIG. 2 is a schematic view of the frame of the parking garage elevator system.
Figure 3A:
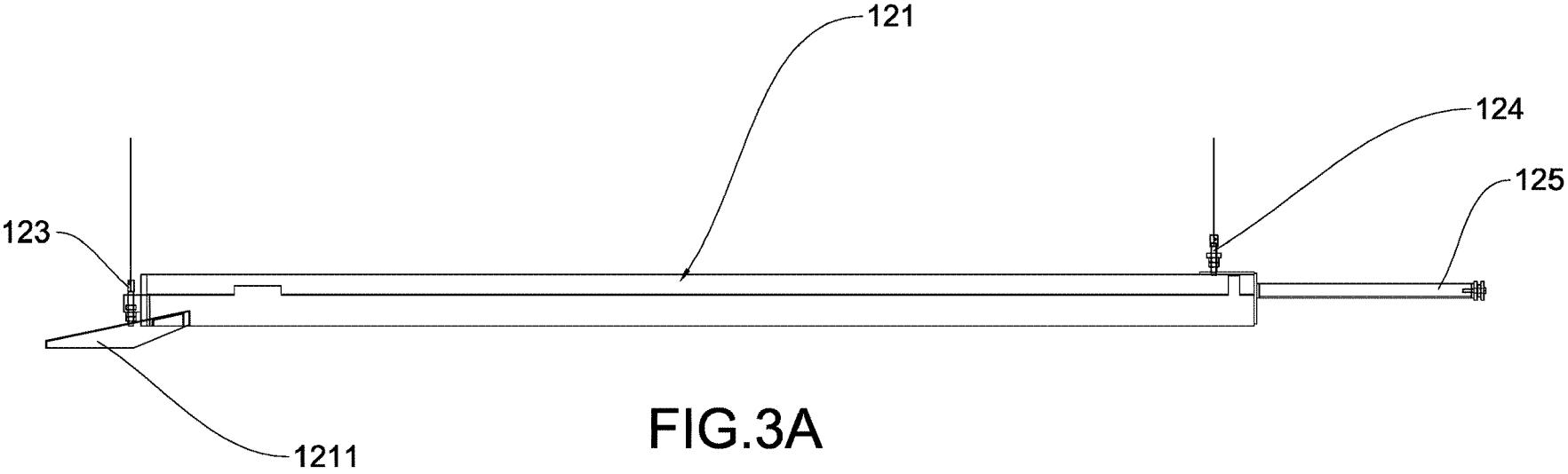
FIG. 3A is a schematic view of the upper automobile platform.
Figure 3B:
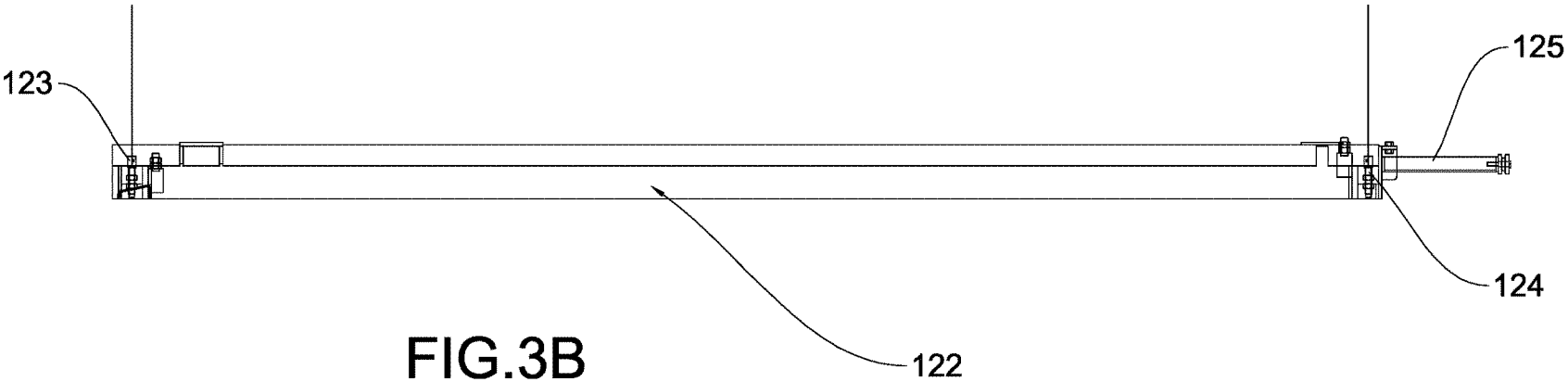
FIG. 3B is a schematic view of the lower automobile platform.
Figure 4:
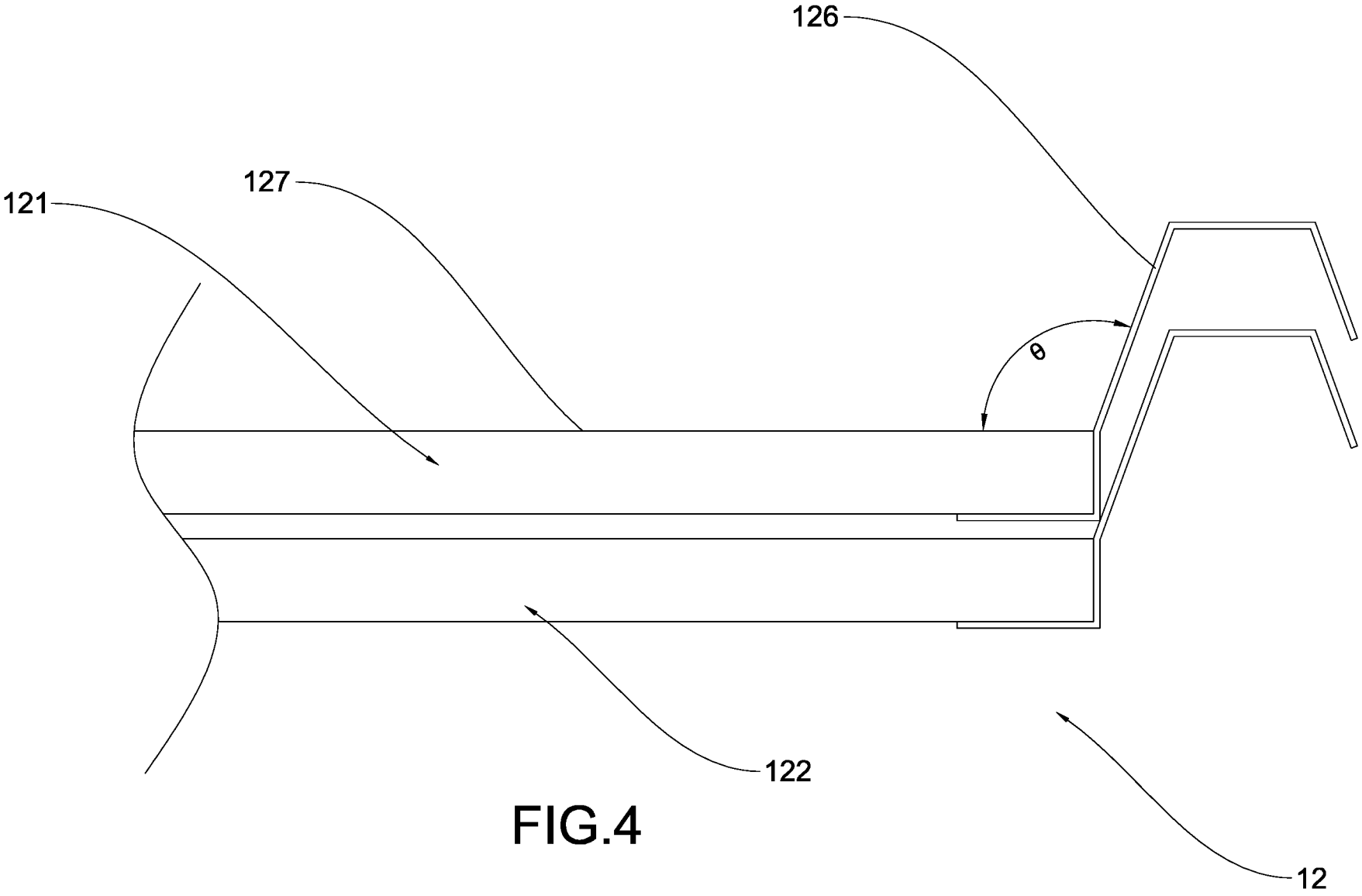
FIG. 4 is a schematic view of the upper automobile platform rested on the lower automobile platform.
Figure 5:
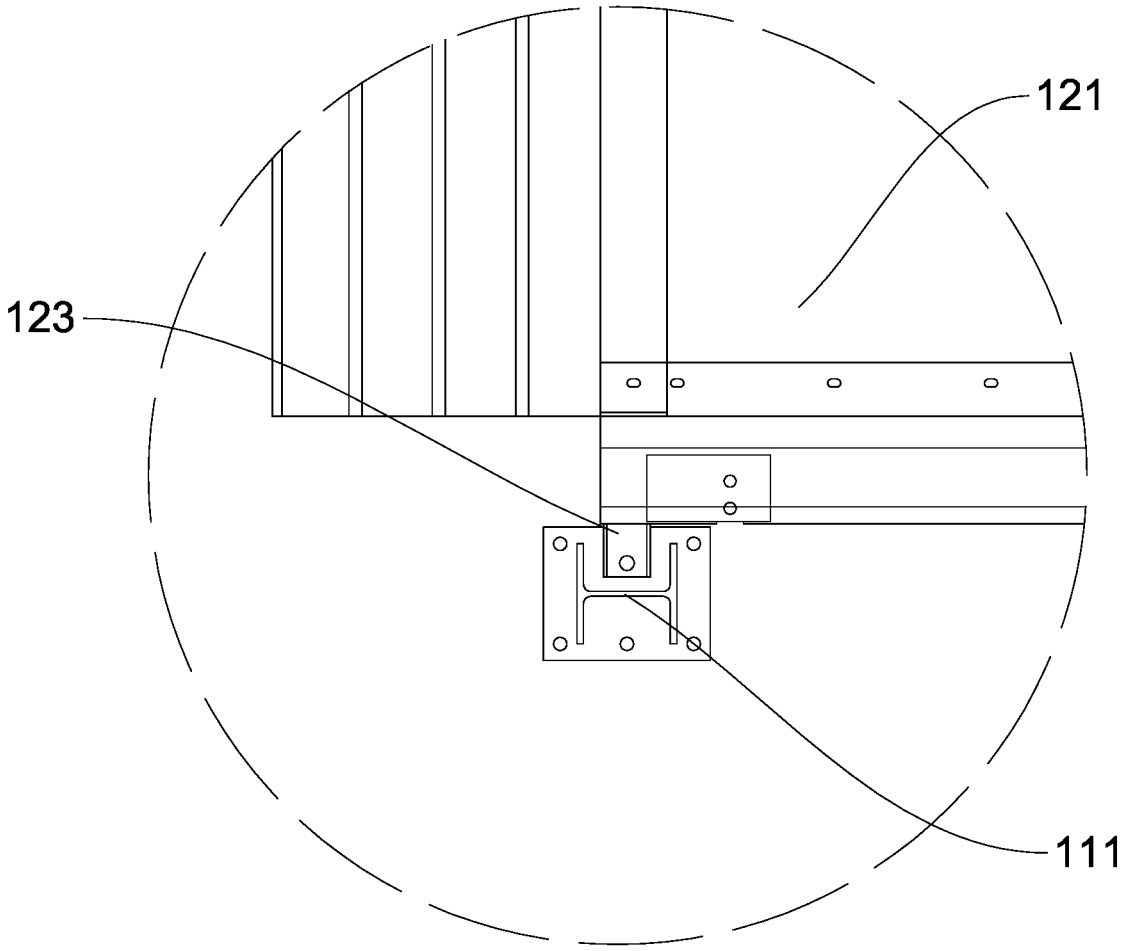
FIG. 5 is a greatly enlarged schematic view of an end of the upper automobile platform.
Figure 6:
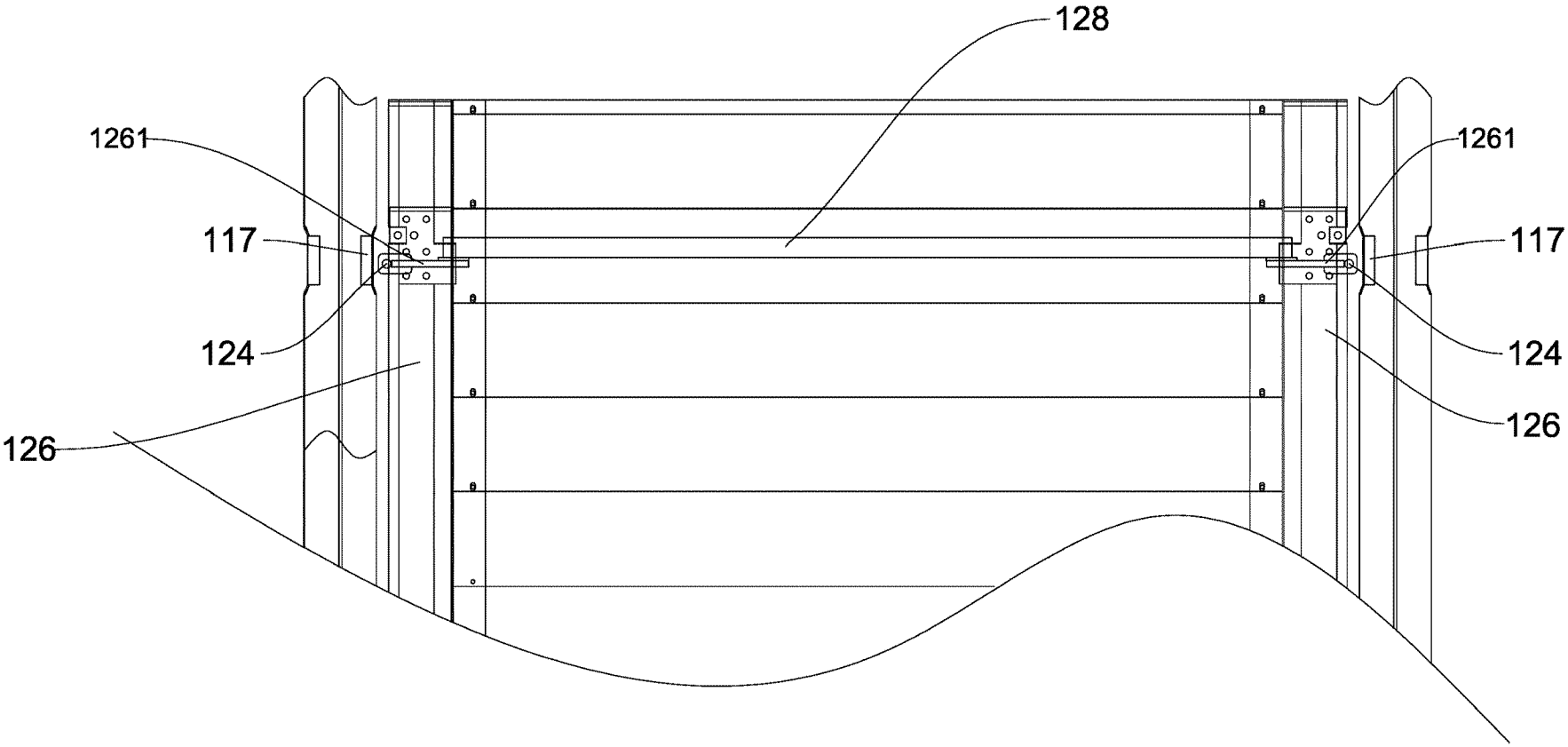
FIG. 6 is a schematic view showing components of the upper automobile platform.
Figure 7:
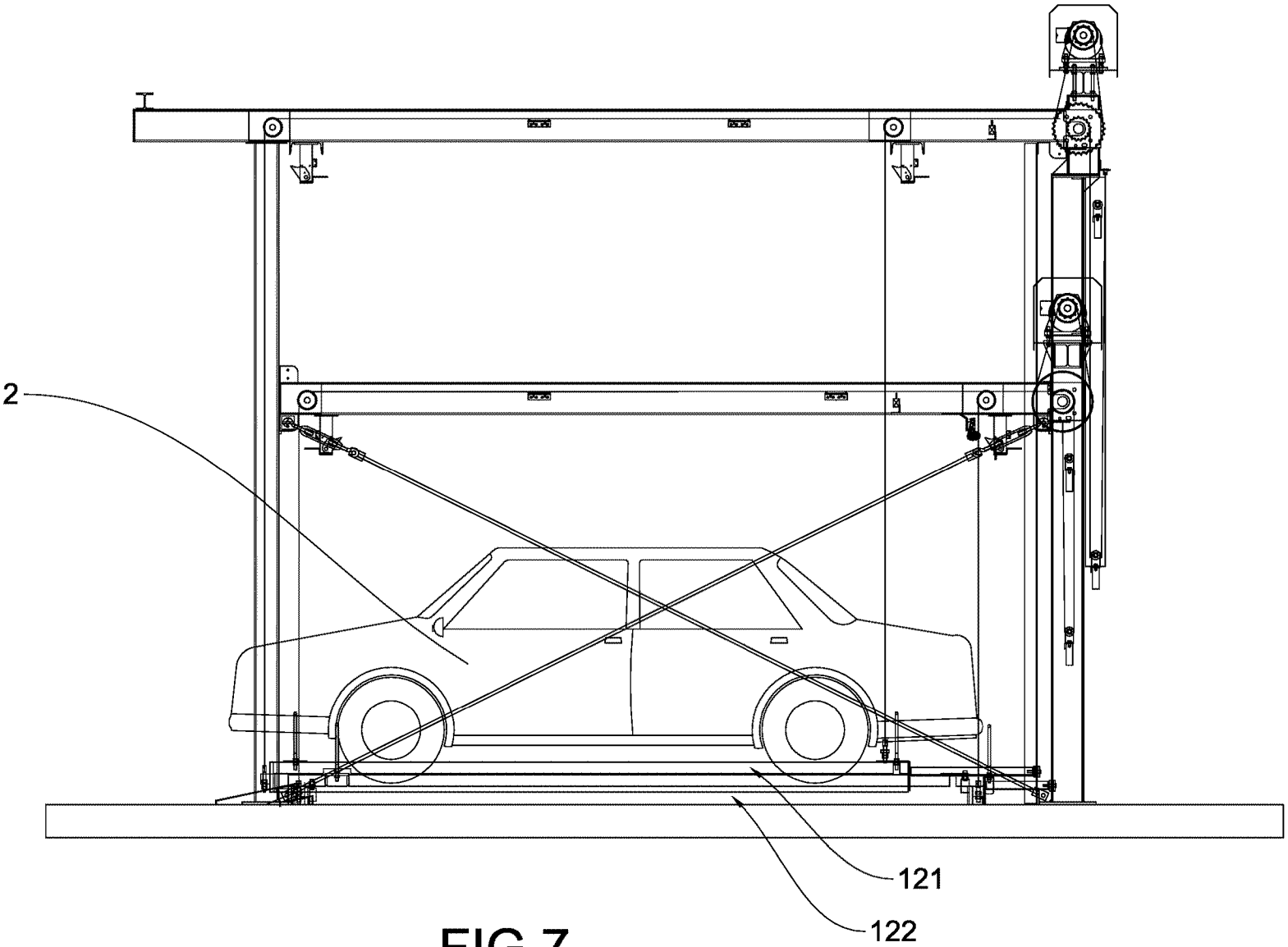
FIGS. 7 to 11 are schematic views showing steps of parking three automobiles in the parking garage elevator system.
Figure 8:
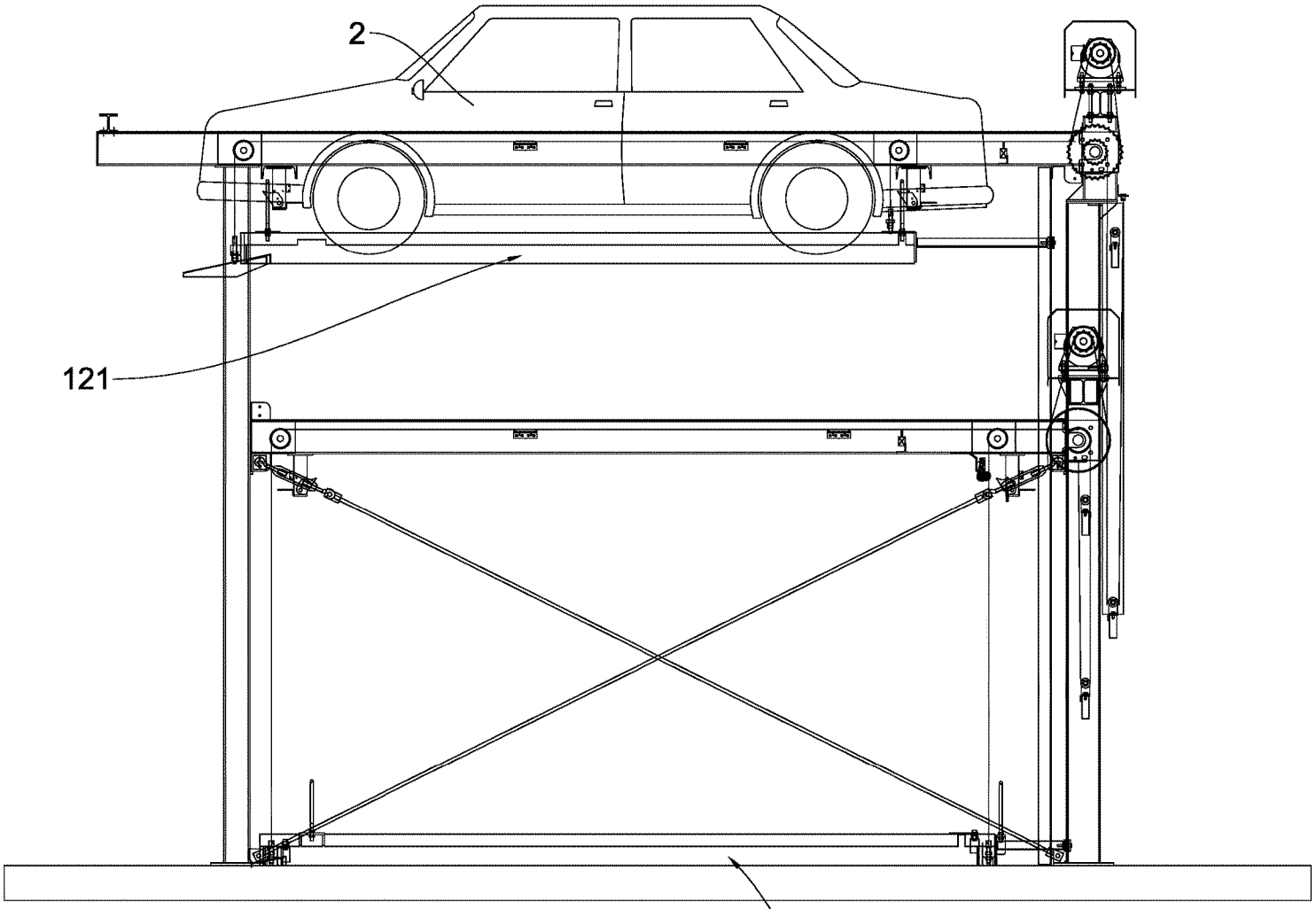
Figure 9:
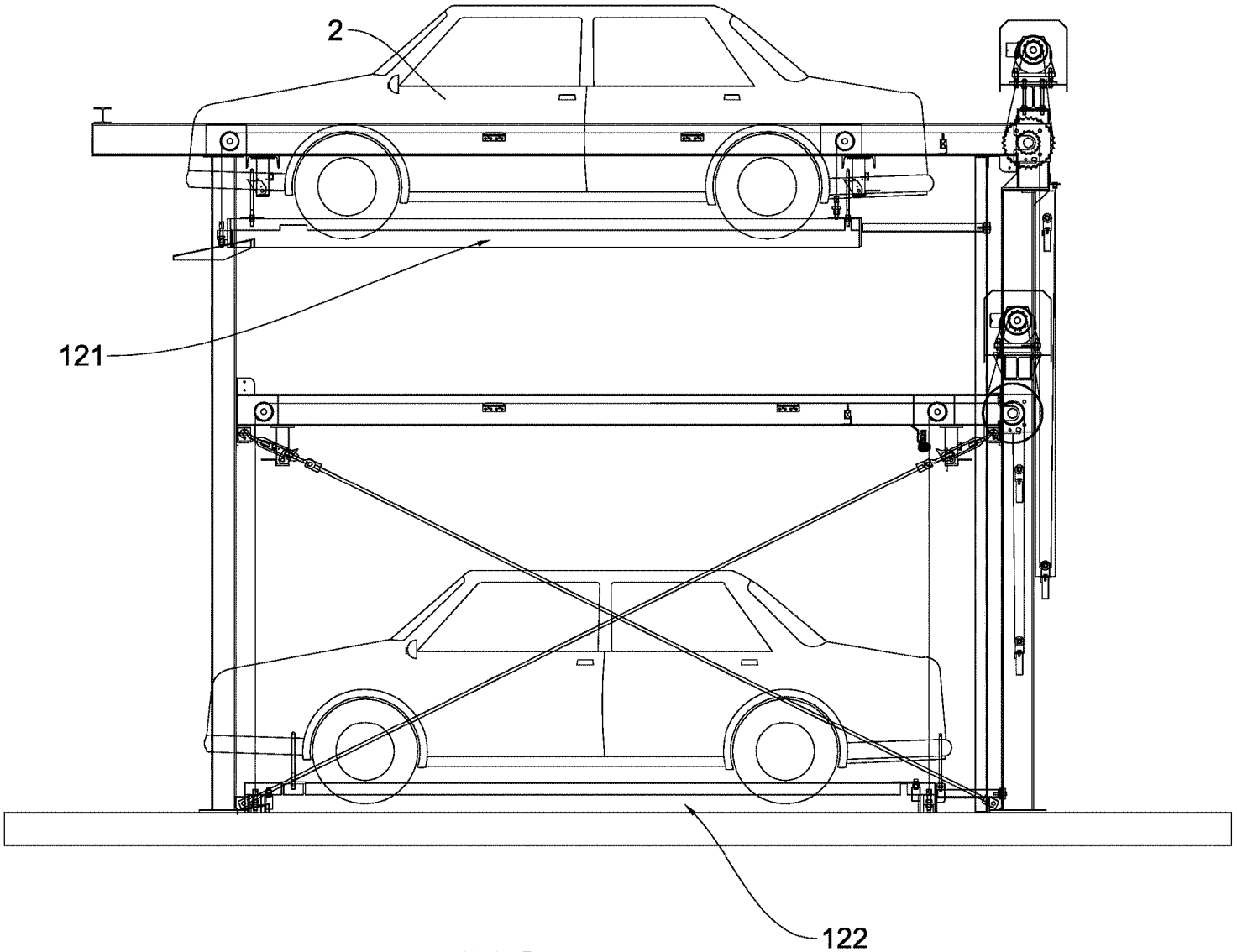
Figure 10:
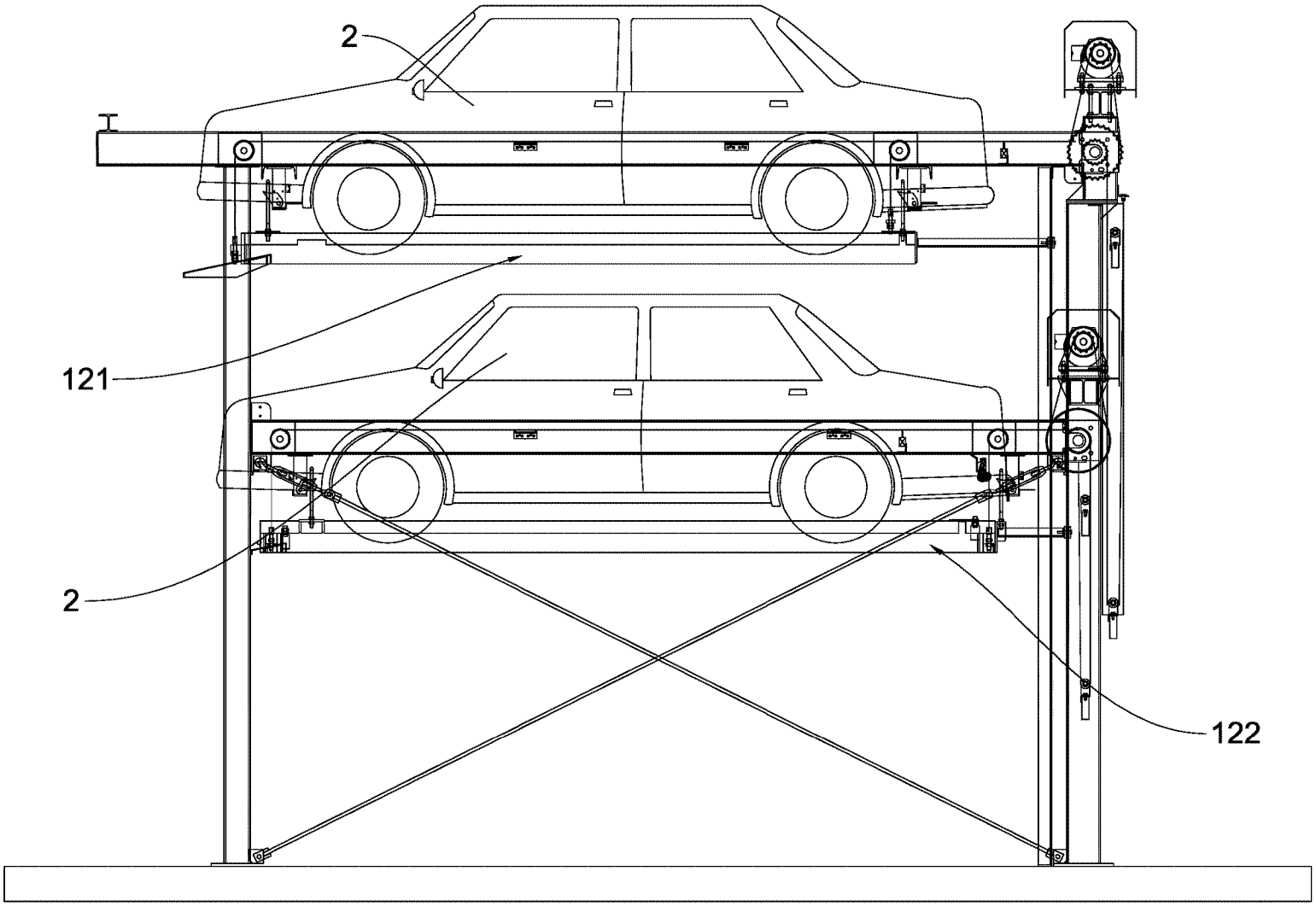
Figure 11:
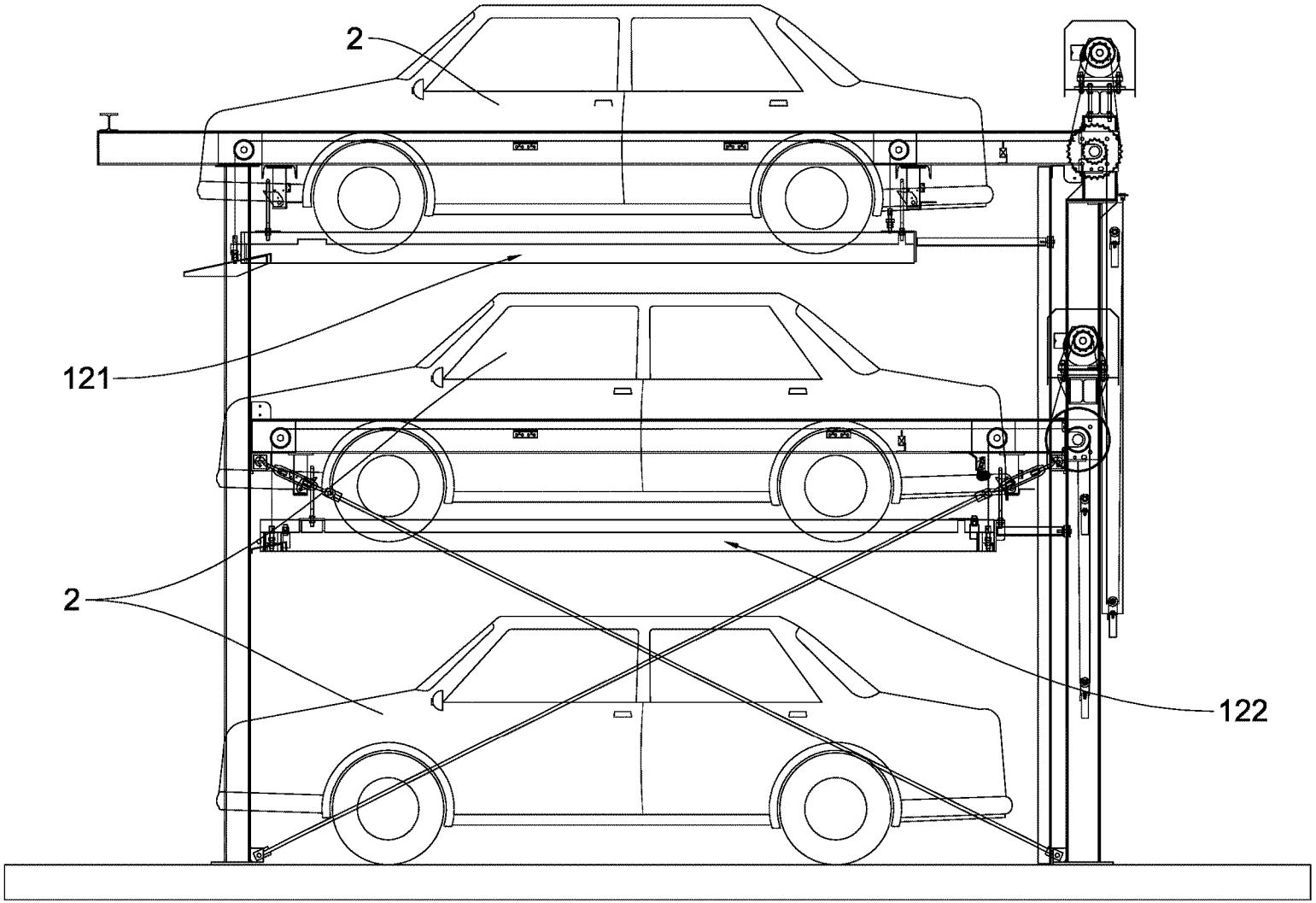

Referring to FIGS. 1 to 11, a parking garage elevator system 1 in accordance with the invention comprises a frame 11, a platform assembly 12, a power transmitting mechanism 13 and a safety mechanism 14 as discussed in detail below.

The frame 11 includes two front posts 111, two rear posts 112, two upper support members 113 each interconnecting upper ends of the front and rear posts 111, 112 of the same side, two middle support members 114 each interconnecting intermediate portions of the front and rear posts 111, 112 of the same side, and two cross braces 115 each interconnecting front ends or rear ends of the upper support members 113. Each of the front posts 111, the rear posts 112, the upper support members 113, the middle support members 114 and the cross braces 115 are metal bars having an H-shaped cross-section. Further, two sets of two guy-wires 116 are provided on two sides of the frame 11 respectively in which each of the guy-wires 116 of the same set interconnect the front post 111 and the rear posts 112 of the same side for adding stability of the frame 11. The guy-wires 116 of the same set cross each other.

The platform assembly 12 includes an upper automobile platform 121 under the upper support members 113, and a lower automobile platform 122 under the middle support members 114. Each of the upper automobile platform 121 and the lower automobile platform 122 include a front suspension seat 123 and a rear suspension seat 124; a guide roller 125 for balance purposes; and two projections 126 along two sides respectively and a flat parking zone 127 between the projections 126 and threadedly secured thereto. An angle θ between the parking zone 127 and the projection 126 is in the range of 100-150 degrees. The front suspension seat 123 of the upper automobile platform 121 may move downward or upward along the front post 111. The front suspension seat 123 is disposed in the cavity of the H-shaped metal bar so that the upper automobile platform 121 may not interfere with the middle support members 114 in the vertical movement and the balance of the upper automobile platform 121 can be maintained. The projection 126 includes a seating member 1261 on the upper automobile platform 121 so that the rear suspension seat 124 may be disposed between the projection 126 and the seating member 1262. The upper suspension seat 121 includes a ramp 1211 at an end for facilitating an automobile 2 to enter the upper suspension seat 121. An enhancement member 128 interconnects the rear suspension seats 124 for load sharing purposes.

The power transmitting mechanism 13 for lifting or lowering the upper automobile platform 121 and/or the lower automobile platform 122 is provided with a first electric motor 131 on the upper support member 113, a second electric motor 132 on the middle support member 114, two chains 133 each for transferring power from the first electric motor 131 to the upper automobile platform 121 or from the second electric motor 132 to the lower automobile platform 122. The first electric motor 131 and the second electric motor 132 are spaced apart so that there is no interference between the upper automobile platform 121 and the lower automobile platform 122 in a lifting or lowering operation.

The safety mechanism 14 is provided for preventing each of the upper automobile platform 121 and the lower automobile platform 122 from falling in the lifting or lowering operation and includes four sets of two safety hooks 141 in which the upper two sets of the safety hooks 141 are provided under the upper support members 113 and the lower two sets of the safety hooks 141 are provided under the middle support members 114. The safety mechanism 14 further comprises a plurality of restrain screws 142 disposed on the upper automobile platform 121 or the lower automobile platform 122. The safety hook 141 includes an electromagnet and a hook member which may automatically fall into the restrain screw 142 to prevent the upper automobile platform 121 or the lower automobile platform 122 from falling in case of power outage.

An inclined plate 117 is provided on each of the middle support members 114 for facilitating the upper automobile platform 121 to pass through the middle support members 114 in the lifting or lowering operation, i.e., the rear suspension seat 124 of the upper automobile platform 121 smoothly passing through the middle support members 114. The inclined plate 171 is tapered from top to bottom and shaped as a wedge. A traction member (not shown) is provided on each of the parking zone 127 and the ramp 1211 for increasing traction of the wheels of the automobile 2 thereon.

Referring to FIGS. 7 to 11 specifically, an operation of the parking garage elevator system 1 is detailed below. Both the lower automobile platform 122 and the upper automobile platform 121 are lowered to a lowest position to be in proximity each other. Next, the first automobile 2 is driven to park on the upper automobile platform 121. Next, the upper automobile platform 121 is lifted to a predetermined position. Then a second automobile 2 is driven to park on the lower automobile platform 122. Next, the lower automobile platform 122 is lifted to a predetermined position. Finally, a third automobile 2 is driven to park on the ground.

For moving the automobiles 2, firstly the third automobile 2 is driven to exit the ground. Next, the lower automobile platform 122 is lowered to rest on the ground. Next, the second automobile 2 is driven to exit the ground. Finally, the upper automobile platform 121 is lowered to rest on the lower automobile platform 122. The first automobile 2 is driven to exit the ground.

While the invention has been described in terms of preferred embodiments, those skilled in the art will recognize that the invention can be practiced with modifications within the spirit and scope of the appended claims.

What is claimed is:

1. A parking garage elevator system, comprising a frame, a platform assembly, a power transmitting mechanism, and a safety mechanism wherein:

the frame includes two front posts, two rear posts, two upper support members each interconnecting upper ends of the front and rear posts of the same side, two middle support members each interconnecting intermediate portions of the front and rear posts of the same side, and two cross braces each interconnecting front ends or rear ends of the upper support members;

the platform assembly is horizontally disposed in the frame and includes an upper automobile platform under the upper support members, and a lower automobile platform under the middle support members, each of the upper and lower automobile platforms include a front suspension seat and a rear suspension seat; a guide roller; and two projections along two sides respectively and a parking zone between the projections;

the power transmitting mechanism is configured to lift or lower the upper automobile platform and/or the lower automobile platform and includes a first electric motor on the upper support member, a second electric motor on the middle support member, and two chains each for transferring power from the first electric motor to the upper automobile platform or from the second electric motor to the lower automobile platform, the first electric motor and the second electric motor being spaced apart; and the safety mechanism includes four sets of two safety hooks, the upper two sets of the safety hooks being disposed under the upper support members and the lower two sets of the safety hooks being provided under the middle support members; and a plurality of restrain screws disposed on the upper automobile platform or the lower automobile platform; and each of the safety hooks is configured to fall into the corresponding restrain screw to prevent each of the upper and lower automobile platforms from falling in a lifting or lowering operation in case of power outage.

2. The parking garage elevator system of claim 1, wherein each of the front posts, the rear posts, the upper support members, the middle support members, and the cross braces are metal bars having an H-shaped cross-section.

3. The parking garage elevator system of claim 1, further comprising two sets of two guy-wires on two sides of the frame respectively wherein each of the guy-wires of the same set interconnect the front post and the rear posts of the same side.

4. The parking garage elevator system of claim 1, wherein the parking zone is at an angle θ with respect to either one of the projections and the angle θ ranges between 100 and 150 degrees.

5. The parking garage elevator system of claim 2, wherein the front suspension seat is disposed in the cavity of the H-shaped metal bar.

6. The parking garage elevator system of claim 1, wherein the projection includes a seating member on the upper automobile platform.

7. The parking garage elevator system of claim 1, further comprising an enhancement member interconnecting the rear suspension seats.

8. The parking garage elevator system of claim 1, further comprising an inclined plate on the lower automobile platform wherein in the inclined plate is tapered from top to bottom and shaped as a wedge.

9. The parking garage elevator system of claim 1, further comprising an inclined plate on each of the middle support members.

10. The parking garage elevator system of claim 1, wherein the upper suspension seat include a ramp at an end.

* * * * *